US005795059A

United States Patent [19]

Brenner et al.

[11] Patent Number: 5,795,059

[45] Date of Patent: Aug. 18, 1998

[54] PUSH-IN LAMPHOLDER MOUNTING SYSTEM

[75] Inventors: Stanley S. Brenner, East Northport; Charles Chase, East Meadow, both of N.Y.

[73] Assignee: Leviton Manufacturing Co., Inc., Little Neck, N.Y.

[21] Appl. No.: 588,191

[22] Filed: Jan. 18, 1996

[51] Int. Cl.[6] ..... F21P 1/00

[52] U.S. Cl. ..... 362/368; 362/382; 362/226

[58] Field of Search ..... 362/226, 368, 362/389, 249, 806, 382, 123, 457, 372; 439/356, 375, 680, 702, 707, 734

[56] References Cited

U.S. PATENT DOCUMENTS

| | | | |
|---|---|---|---|
| 991,185 | 5/1911 | Weeks | 362/368 |
| 4,361,864 | 11/1982 | Spiro | 362/368 |
| 5,001,615 | 3/1991 | Stefanelli | 362/226 |
| 5,192,127 | 3/1993 | Schaef | 362/226 |
| 5,278,741 | 1/1994 | Ehrman | 362/249 |
| 5,418,698 | 5/1995 | Wu | 362/226 |
| 5,428,516 | 6/1995 | Harris | 362/249 |
| 5,580,159 | 12/1996 | Liu | 362/806 |

*Primary Examiner*—Thomas M. Sember
*Attorney, Agent, or Firm*—Paul J. Sutton

[57] ABSTRACT

A lighting fixture composed of a lampholder which can receive an electrical lamp and supply to it AC power and a body member into which the lampholder can be placed for support and protection. A locking member in the form of a flat, resilient metallic band with end portions bent at an acute angle provides a one-way clutch which permits the lampholder to be placed into the body member but prevents its withdrawal. Channels in the interior wall of the body receive the band ends to prevent rotation of the lampholder. The channels are employed in pairs and a single pair or two pairs at right angles to each other are employed.

11 Claims, 3 Drawing Sheets

PUSH-IN LAMPHOLDER MOUNTING SYSTEM

BACKGROUND OF THE INVENTION

1. Field of the Invention

The invention is directed to a lighting fixture of the type which can be used outdoors or in locations where the fixture must be protected and more particularly to a fixture made up of a protective body or shell into which is placed a non-removable lampholder.

2. Description of the Prior Art

At present lighting fixtures for use outdoor or in locations where they must be protected are made up of a metallic outer shell and a ceramic lampholder which is placed within the shell. To fasten the lampholder to the shell, the shell interior, at its substantially closed end, has a built up boss with a central bore extending from the exterior of said end to the interior end of said boss. A cavity is provided in the lampholder covered by a metal insert having a threaded aperature. The lampholder is inserted into the shell and the threaded aperature in the metal insert is aligned with the bore in the boss and a screw is inserted through the hole in the exterior of the shell, through the bore of said boss and made to threadably engage the threaded aperature in said insert until the lampholder is in direct contact with the boss.

The above described assembly of the lampholder and shell is not that simple in actual practice because the lampholder is free to rotate or move away from the boss so that the assembly screw does not enter the threaded aperture of the insert. Further, the presence of the phase, the neutral and ground conductors in the space between the end of the lampholder and the end of the shell also interferes with proper assembly. The presence of an aperature through the shell permits entry of water, moisture or dirt into the lampholder which could cause failure of the fixture.

SUMMARY OF THE INVENTION

The present invention overcomes the difficulties noted above with respect to prior art devices by providing a hollow shell which does not include an aperture through its end and which requires no interior boss. The shell has an interior lip adjacent the lamp entry to limit insertion of a lampholder therein. A flat, resilient, metallic locking member is attached to said lampholder with two portions extending beyond the lampholder periphery, one at each end. The two portions are each bent at the lampholder periphery towards the lamp entry. As the lampholder is forced into the shell the two portions of the locking member, the total length of which is greater than the interior diameter of the shell, are caused to deflect further towards the longitudinal axis of the lampholder to grip the walls which define the interior surface of the shell. The two portions act as one way clutches permitting the lampholder to enter the shell but prevent the withdrawal of the lampholder.

Two or more grooves may be placed in the interior wall of the shell to provide guides for the ends of the locking member as the lampholder is inserted into the shell. The engagement of the locking member ends in one pair of grooves prevents the rotation of the lampholder during insertion of the lampholder into the shell or the rotation of the lampholder when lamps are inserted or removed from the lampholder.

The ends of the locking member may be made sharp to provide a better gripping edge. It is an objective of this invention to provide a novel lighting fixture composed of a protective outer shell and a lampholder positioned within and assembled to said shell.

It is another object of this invention to provide a novel lighting fixture composed of a protective outer shell and a non-removable lampholder positioned within and assembled to said shell.

It is still another object of this invention to provide a novel lighting fixture composed of a protective outer shell and a non-removable lampholder positioned within and assembled to said shell employing a locking means having one way clutch mechanisms at its ends.

It is yet another object of this invention to provide a novel lighting fixture composed of a protective outer shell having at least one pair of grooves on its interior surface and a non-removable lampholder positioned within and assembled to said shell employing a locking means having one way clutch mechanisms at its ends, said ends of said locking means passing non-rotatingly along one pair of said grooves permitting maximum insertion of said lampholder into said shell but preventing withdrawal of said lampholder.

Other objects and features of the invention will be pointed out in the following description and claims and illustrated in the accompanying drawings, which disclose, by way of example, the principles of the invention, and the best modes which are presently contemplated by carrying them out.

A BRIEF DESCRIPTION OF THE DRAWING

In the drawings in which similar elements are given similar reference characters:

DESCRIPTION OF THE PREFERRED EMBODIMENTS

Figure 2:
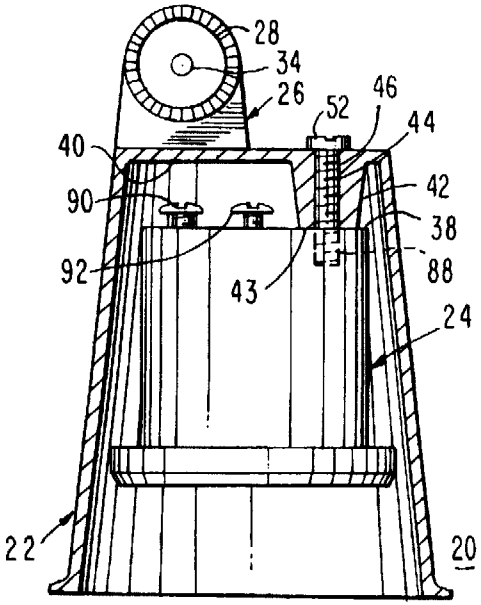
FIG. 2 PRIOR ART
FIG. 2 is a side elevational view, partially in section, of a portion of the lighting fixture of FIG. 1.
Figure 1:
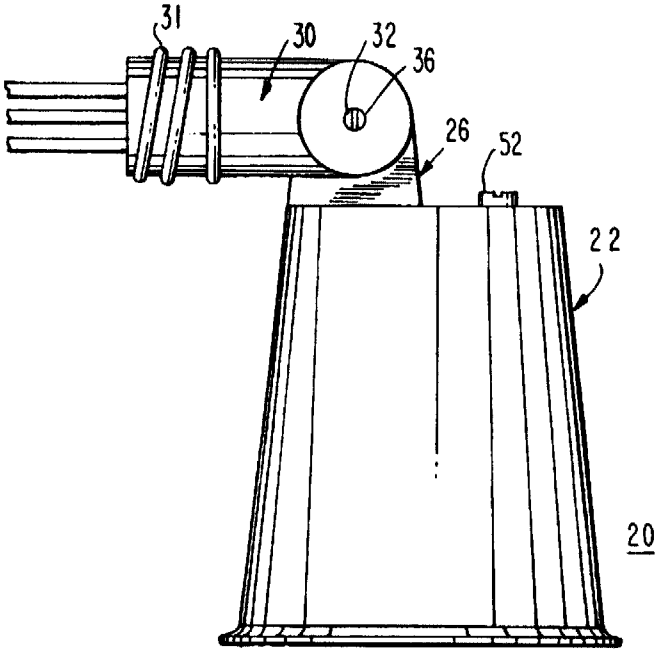
FIG. 1 PRIOR ART
FIG. 1 is a side elevation view of a lighting fixture constructed in accordance with the prior art.
Figure 3:
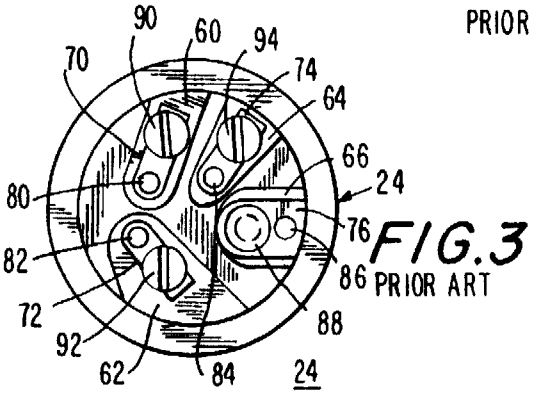
FIG. 3 PRIOR ART
FIG. 3 is a top plan view of the lampholder of the lighting fixture of FIG. 1.

Turning to FIGS. 1, 2 and 3 there is shown a lighting fixture 20 constructed in accordance with the prior art. Fixture 20 has a shell or body member 22 within which is placed a lampholder 24 having an open end and a central cavity which contains a threaded metal insert to receive the base of an incandescent lamp (not shown) and connect electrical conductors thereto (not shown). A hub 26 having a number of raised ribs arranged in a circular band 28 is made to engage a similar circular band of raised ribs on the interior of extension 30. A fastener 36 passes through aperture 32 in extension 30 and engages threaded aperture 34 in hub 26. By engaging the raised ribs of band 28 with the recesses between the raised ribs 28 of extension 30, and tightening the fastener 36, the shell 22 can be set with respect to extension 30 over an arc of more than 180 degrees.

To fasten the lampholder 24 with respect to shell 22, there is provided on the interior surface of the substantially closed end 40 of shell 22 a boss 42 having a central bore 44 therethrough. An aperture 46 through the end 40 permits a fastener, such a bolt 52, to pass thru the central bore 44.

The lampholder 24, which is made of ceramic, plastic or the like has a number of depressions 60, 62, 64 and 66. Within each of the depressions 60, 62 and 64 there is a metal insert 70, 72 and 74 respectively fastened to the lampholder body by rivets or eyelets 80, 82 and 84 respectively. A threaded aperture (not visible) in each of the metal inserts 70, 72 and 74 receives a binding head bolt 90, 92 and 94, respectively, so that the phase, neutral and ground conductors of a supply cable (not shown) can be connected to lampholder 24. As is known in the art one of metal inserts 70, 72 and 74 is connected to the threaded insert inside the lampholder to contact one side of the inserted lamp filament. A second insert is connected to the flexible tongue which engages the lamp base contact to connect to the second side of the inserted lamp filament. The remaining insert is connect to the system ground.

A further insert 76 is placed in depression 66 and fastened to the lampholder body by rivet or eyelet 86. A threaded aperture 88 in insert 76 is dimensioned to receive bolt 52. By engaging bolt 52 with threaded aperture 88 the lampholder 24 is anchored to the body 22. The engagement of end 38 of lampholder 24 with the face 43 of boss 42 provides space for receiving the conductors of the feed cable (not shown). After the conductors leave the terminal screws 90, 92 and 94 they pass through an aperture 100 in end 40 (see FIG. 10) through passageways in hub 26 and extension 30 to the feed cable (not shown). The free end of extension 30 has an external thread 31 which permits extension 30 to threadedly engage an electrical box or the like or to be placed in a knock-out and attached thereto by a lock nut (not shown).

Because lampholder 24 is free to rotate and because of the presence of the various conductors between end 40 of body or shell 22 and face 38 of lampholder 24, it is difficult to align aperture 88 in lampholder 24 with bore 44 in boss 42 of body 22, and engage bolt 52 with threaded aperture 88. Also the presence of aperture 46 through end 40 can permit water, moisture, dirt or other debris to enter the shell 22 and possibly adversely affect the fixture.

Figure 7:
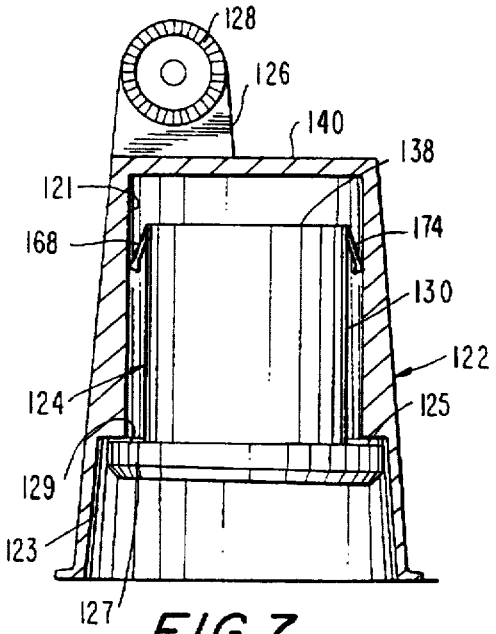
FIG. 7 is a side elevational view, partly in section, of a lighting fixture constructed in accordance with the concepts of the invention.

As shown in FIG. 7, the body 122 eliminates the aperture 46 through the end 140 as well as the boss 42 with bore extending from end 140 inwardly to engage the end 138 of lampholder 124. To provide the requisite space, for the conductors connected to lampholder 124, between end 138 of lampholder 124 and end 140 of body 122, a step 125 is provided between a first bore 121 and a second bore 123 of a larger diameter. The back surface 129 of rim 127 adjacent the open end of lampholder 124 (see FIG. 4) engages the step 125 to limit insertion of lampholder 124 into shell or body 122 and provide the required conductor space. A hub 126 extends from end 140 and has a circular band 128 of raised ribs for engagement with an extension 30.

Figure 5:
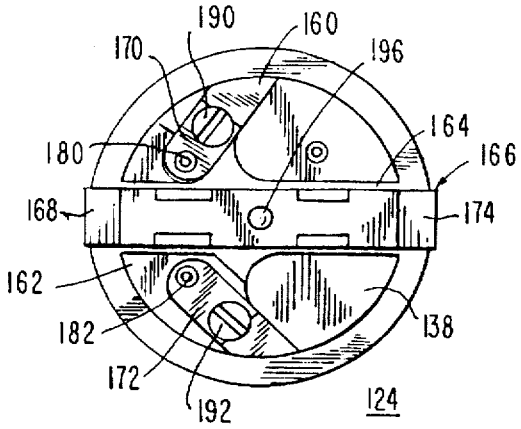
FIG. 5 is a top plan view of the lampholder of FIG. 4.
Figure 6:
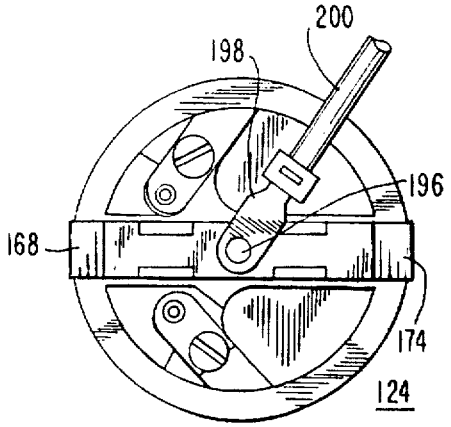
FIG. 6 is a top plan view of the lampholder of FIG. 5 with a ground conductor attached.
Figure 4:
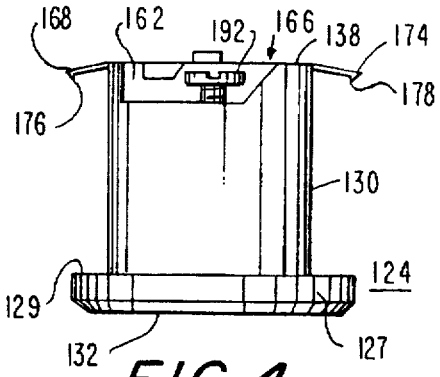
FIG. 4 is a side elevational view of a lampholder constructed according to the concepts of the invention.

Referring now to FIGS. 4, 5 and 6 a lampholder 124 according to the instant invention is shown. The body 130 is made of ceramic, plastic or the like extending from an open end 132 to a substantially closed end 138 and has a cavity therein, in which is placed a threaded insert (not shown) into which the lamp base is screwed. The screw insert is connected to one conductor terminal screw 190 mounted on closed end 138. At the center of the insert base and insulated from it is a tongue to contact the central base contact of the inserted lamp (not shown). This tongue is connected to another conductor terminal screw 192 mounted on closed end 138.

The external surface of closed end 138 is provided with recesses 160 and 162 in which are placed metal inserts 170 and 172 respectively. Insert 170 is anchored to closed end 138 by rivet or eyelet 180 while insert 172 is anchored to closed end 138 by rivet or eyelet 182. A threaded aperture (not shown) in insert 170 receives terminal screw 190 while another in insert 172 receives terminal screw 192.

A further recess 164 extends across the entire closed end 138. Placed in recess 164 is a locking band 166 made of a flat, resilient, metallic band. The band 166 extends beyond the body 130. Band portion 168 extends to the left beyond body 130 in FIG. 4 while band portion 174 extends to the right beyond body 130 in the same FIG. 4. Band portion 168 is bend downwardly at an acute angle to the horizontal, main portion of band 166 at the edge of body 130 and band portion 174 is also bent at an acute angle to the horizontal main portion of band 166 at the edge of body 130, as is shown in FIG. 4. The free ends of band portions 168 and 174 have sharp edges 176 and 178 respectively.

As the lampholder 124 is advanced into the shell 124, the band portions 168 and 174 bend towards the longitudinal axis of lampholder 124 permitting it to advance until surface 129 of rim 127 is in contact with step 125. Any attempt to withdraw lampholder 124 causes the edges 176 and 178 to more fully engage the wall that defines bore 121 and attempt to rotate band portions 168 and 174 which further jams edges 176 and 178 against bore 121 wall maintaining the position of lampholder 124 in shell 122. The band 166 is fixed to end 138 by a rivet 196 or the like. A ground conductor 200 connected to a terminal 198 may also be fastened to the band 166 and end 138 by rivet 196 as shown in FIG. 6. The conductors are pulled out of slot 100 in end 140 as the lampholder 124 is advanced into the shell 122 to prevent these conductors from interfering with the full insertion of lampholder 124 into shell 122.

Figure 8:
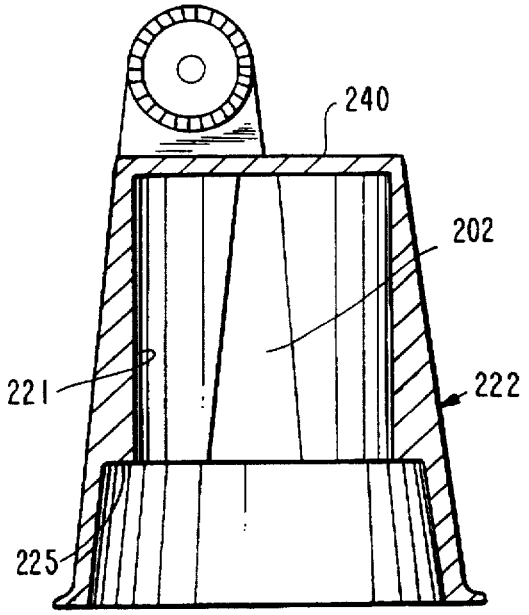
FIG. 8 is a side elevational view, partly in section, of a further body member or shell constructed in accordance with the concepts of the invention.
Figure 10:
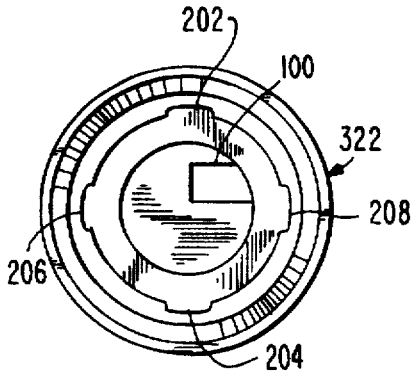
FIG. 10 is a bottom plan view of an alternative embodiment of a body member or shell constructed in accordance with the concepts of the invention.
Figure 9:
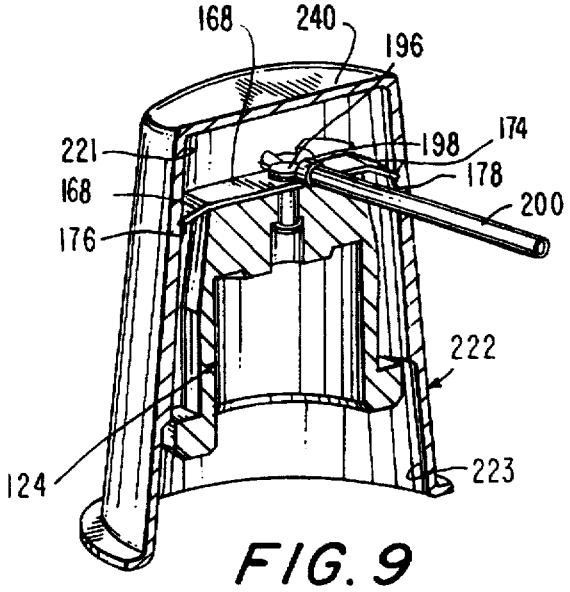
FIG. 9 is a perspective view, partly in section, of the assembly of the lampholder of FIG. 4 with the body member or shell of FIG. 8.

Since the interior wall defining bore 121 is smooth it is possible for the lampholder 124 to rotate as it is being advanced into the shell 222. To prevent this a pair of channels 202 and 204 (see FIGS. 8, 10) are placed in the wall defining bore 221. The channels start at the step 225 and continue to end 240. The band portions 176 and 178 move within channels 202 and 204 to prevent the rotation of lampholder 124 with respect to shell 122 as it is seated in such shell (see FIG. 9). If desired two pairs of channels 202, 204 and 206, 208 can be used as shown in FIG. 10 in shell 322.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A lighting fixture comprising:

a. a rigid lampholder means for receiving an electrical lamp therein and applying AC power thereto by means of electrical conductors to cause said electrical lamp to be illuminated;

b. a rigid body means having a cavity therein extending from a first open end to a second substantially closed end;

c. said lampholder means positioned in said cavity of said body means to permit an electrical lamp inserted through said body means first end to be received in said lampholder means and to permit said electrical conductors to exit said body means at said second substantially closed end;

d. locking means mounted on said lampholder means to engage a wall of said body means defining said cavity to prevent removal of said lampholder means from said body means;

e. at least two groove means in the wall of said body means defining said cavity extending between said first open end and said second substantially closed end, said at least two groove means are positioned in line with one another on opposite portions of said wall of said body means defining said cavity; and f. at least a portion of said locking means engages said wall in said at least two groove means to prevent rotation of said lampholder means within said body means.

2. A lighting fixture as defined in claim 1, wherein said locking means is a flat metallic strip having a first end and a second end; said first end engaging a first of said at least two groove means and the second end engaging a second of said at least two groove means positioned in line with said first of said at least two groove means to prevent rotation of said lampholder means within said body means.

3. A lighting fixture as defined in claim 2, wherein said flat metallic strip is fastened to said lampholder means.

4. A lighting fixture comprising:

a. a rigid lampholder means for receiving an electrical lamp therein and applying AC power thereto by means of electrical conductors to cause said electrical lamp to be illuminated;

b. a rigid body means having a cavity therein extending from a first open end to a second substantially closed end;

c. said lampholder means positioned in said cavity of said body means to permit an electrical lamp inserted through said body means first end to be received in said lampholder means and to permit said electrical conductors to exit said body means at said second substantially closed end;

d. locking means mounted on said lampholder means to engage a wall of said body means defining said cavity to prevent removal of said lampholder means from said body means;

e. at least two groove means in the wall of said body means defining said cavity extending between said first open end and said second substantially closed end, wherein said at least two groove means are four groove means arranged in two pairs, a first groove means of a first pair of said groove means positioned in line with the second groove means of said first pair of groove means on opposite portions of said wall of said body means defining said cavity and a first groove means of the second pair of said groove means positioned in line with the second groove means of said second pair of groove means on opposite portions of said wall of said body means defining said cavity and wherein a line connecting said first and second groove means of said first pair of said groove means is perpendicular to a line connecting said first and second groove means of said second pair of groove means; and f. at least a portion of said locking means engages said wall in said at least two groove means to prevent rotation of said lampholder means within said body means.

5. A lighting fixture as defined in claim 4, wherein said locking means is a flat metallic strip having a first end and a second end, said metallic strip spanning the two groove means which make up one of the two groove means pairs to prevent rotation of said lampholder means within said body means.

6. A lighting fixture comprising:

a. a rigid lampholder means for receiving an electrical lamp therein and applying AC power thereto by means of electrical conductors to cause said electrical lamp to be illuminated;

b. a rigid body means having a cavity therein extending from a first open end to a second substantially closed end;

c. said lampholder means positioned in said cavity of said body means to permit an electrical lamp inserted through said body means first end to be received in said lampholder means and to permit said electrical conductors to exit said body means at said second substantially closed end;

d. locking means mounted on said lampholder means to engage the wall of said body means defining said cavity to prevent removal of said lampholder means from said body means; and e. said locking means is a flat metallic strip having a first end and a second end, said first and second ends engaging a wall of said body means defining said cavity.

7. A lighting fixture as defined in claim 6, wherein said flat metallic strip is fastened to said lampholder means.

8. A light fixture comprising:

a. lampholder means for receiving an electrical lamp therein and applying for AC power thereto by means of electrical conductors to cause said electrical lamp to be illuminated;

b. body means having a cavity therein extending from a first open end to a second substantially closed end;

c. said lampholder means positioned in said cavity of said body means to permit an electrical lamp inserted through said body means first end to be received in said lampholder means and to permit said electrical conductors to exit said body means at said second substantially closed end;

d. locking means mounted on said lampholder means to engage a wall of said body means defining said cavity to prevent removal of said lampholder means from said body means;

e. at least two groove means in the wall of said body means defining said cavity extending between said first open end and said second substantially closed end;

f. at least a portion of said locking means engages said wall in said at least two groove means to prevent rotation of said lampholder means within said body means; and g. said locking means is a flat, resilient metallic strip having a first end and a second end, and a strip body portion therebetween, a portion of said strip adjacent each of said first and second ends extending beyond said body means and bent at an acute angle to said strip body portion to act as a one-way clutch, said first and second ends engaging the wall of said body means defining said cavity, said first end engaging a first of said at least two groove means and said second end engaging a second of said at least two groove means positioned in line with one another on opposite portions of said wall of said body means defining said cavity, said bent portions of said strip permitting said lampholder means to be advanced into said body means but prevents said lampholder means being removed from said body means.

9. A lighting fixture comprising:

a. lampholder means for receiving an electrical lamp therein and applying for AC power thereto by means of electrical conductors to cause said electrical lamp to be illuminated;

b. body means having a cavity therein extending from a first open end to a second substantially closed end;

c. said lampholder means positioned in said cavity of said body means to permit an electrical lamp inserted through said body means first end to be received in said lampholder means and to permit said electrical conductors to exit said body means at said second substantially closed end;

d. locking means mounted on said lampholder means to engage a wall of said body means defining said cavity to prevent removal of said lampholder means from said body means;

e. four groove means in the wall of said body means defining said cavity extending between said first open end and said second substantially closed end arranged in two pairs, the first groove means of a first pair of said groove means positioned in line with the second groove means of said first pair of groove means on opposite portions of said wall of said body means defining said cavity and a first groove means of the second pair of said groove means positioned in line with the second groove means of said second pair of grooved means on opposite portions of said wall of said body means defining said cavity and wherein a line connecting said first and second groove means of said first pair of said groove means is perpendicular to a line connecting said first and second groove means of said second pair of groove means;

f. at least a portion of said locking means engages said wall in at least two groove means to prevent rotation of said lampholder means within said body means; and g. said locking means is a flat, resilient metallic strip having a first end and a second end and a strip body portion therebetween, a portion of said strip adjacent each of said first and second ends extending beyond said body means and bent at an acute angle to said strip body portion to act as a one-way clutch, said first and second ends engaging the wall of said body means defining said cavity, said first end engaging a first groove means of one of said first and second pair of groove means and said second end engaging the second groove means of the same one of said first and second pairs of groove means engaged by said first end, said bent portions of said strip permitting said lampholder means to be advanced into said body means but prevents said lampholder means being removed from said body member.

10. A lighting fixture comprising:

a. lampholder means for receiving an electrical lamp therein and applying for AC power thereto by means of electrical conductors to cause said electrical lamp to be illuminated;

b. body means having a cavity therein extending from a first open end to a second substantially closed end;

c. said lampholder means positioned in said cavity of said body means to permit an electrical lamp inserted through said body means first end to be received in said lampholder means and to permit said electrical conductors to exit said body means at said second substantially closed end;

d. locking means mounted on said lampholder means to engage a wall of said body means defining said cavity to prevent removal of said lampholder means from said body means;

e. said locking means is a flat metallic strip having a first end and a second end, said first and second ends engaging the wall of said body means defining said cavity;

f. said flat metallic strip is fastened to said lampholder means by a fastener means; and g. a ground conductor is fixed to said lampholder means by the fastener means also used to fasten said strip to said lampholder means.

11. A lighting fixture comprising:

a. lampholder means for receiving an electrical lamp therein and applying for AC power thereto by means of electrical conductors to cause said electrical lamp to be illuminated;

b. body means having a cavity therein extending from a first open end to a second substantially closed end;

c. said lampholder means positioned in said cavity of said body means to permit an electrical lamp inserted through said body means first end to be received in said lampholder means and to permit said electrical conductors to exit said body means at said second substantially closed end;

d. locking means mounted on said lampholder means to engage a wall of said body means defining said cavity to prevent removal of said lampholder means from said body means;

e. at least two groove means in the wall of said body means defining said cavity extending between said first open end and said second substantially closed end;

f. at least a portion of said locking means engages said wall in said at least two groove means to prevent rotation of said lampholder means within said body means;

g. said at least two groove means are positioned in line with one another on opposite portions of said wall of said body means defining said cavity;

h. said locking means is a flat metallic strip having a first end and a second end; said first end engaging a first of said at least two groove means and the second end engaging a second of said at least two groove means positioned in line with said first of said at least two groove means to prevent rotation of said lampholder means within said body means;

i. said flat metallic strip is fastened to said lampholder means by a fastener means; and j. a ground conductor is fixed to said lampholder means by the fastener means also used to fasten said strip to said lampholder means.

* * * * *